United States Patent [19]

Madgavkar et al.

[11] Patent Number: 4,671,865

[45] Date of Patent: Jun. 9, 1987

[54] TWO STEP HETEROCYCLIC NITROGEN EXTRACTION FROM PETROLEUM OILS

[75] Inventors: Ajay M. Madgavkar, Katy, Tex.; Donald M. Washecheck, Naperville, Ill.

[73] Assignee: Shell Oil Company, Houston, Tex.

[21] Appl. No.: 781,282

[22] Filed: Sep. 27, 1985

[51] Int. Cl.[4] ..... C10G 67/04

[52] U.S. Cl. ..... 208/96; 208/97; 208/254 R

[58] Field of Search ..... 208/87, 89, 96, 97, 208/254 H, 254 R, 98

[56] References Cited

U.S. PATENT DOCUMENTS

| | | | |
|---|---|---|---|
| 1,686,136 | 10/1928 | Ihrig | 546/1 |
| 2,263,175 | 11/1941 | Lazar et al. | 546/1 |
| 2,263,176 | 11/1941 | Lazar et al. | 208/254 R |
| 2,352,236 | 6/1944 | Thomas | 208/90 |
| 2,518,353 | 8/1950 | McKinnis | 208/254 R |
| 2,541,458 | 2/1951 | Berg | 208/254 R |
| 2,925,375 | 2/1960 | Fleck et al. | 208/89 |
| 2,937,134 | 5/1960 | Bowles | 208/89 |
| 3,436,340 | 4/1969 | Jacobson | 208/254 R |
| 4,271,009 | 6/1981 | Stover | 208/254 R |
| 4,332,675 | 6/1982 | Baset | 208/254 R |
| 4,332,676 | 6/1982 | Baset | 208/254 R |
| 4,392,948 | 7/1983 | Debande | 208/254 R |
| 4,409,092 | 10/1983 | Johnson et al. | 208/89 |
| 4,414,103 | 11/1983 | Farrell | 208/212 |
| 4,426,280 | 1/1984 | Chen et al. | 208/254 R |
| 4,483,763 | 11/1984 | Kuk et al. | 208/254 H |
| 4,605,489 | 8/1986 | Madgavkar | 208/87 |
| 4,623,444 | 11/1986 | Che et al. | 208/92 |

OTHER PUBLICATIONS

Hampel et al., The Encyclopedia of Chemistry 3rd ed. (1973), p. 491.

*Primary Examiner*—Olik Chaudhuri
*Attorney, Agent, or Firm*—Kimbley L. Muller

[57] ABSTRACT

The instant invention discloses a method of removing heterocyclic basic nitrogen compounds from petroleum oils which comprises first enhancing the concentration of the heterocyclic basic nitrogen compounds in a portion of the petroleum oil and then extracting the enhanced portion of the heterocyclic basic nitrogen compounds with a two phase system having an aliphatic carboxylic acid as the extracting agent. In the hydrotreating embodiment of this invention a portion of all of the nitrogen compounds are converted to heterocyclic basic nitrogen compounds and thereby more feasibly extracted. In the distillation embodiment of this invention the nitrogen compounds are actually concentrated and thereby result in a more feasible extraction with the aliphatic carboxylic acid.

24 Claims, 3 Drawing Figures

TWO STEP HETEROCYCLIC NITROGEN EXTRACTION FROM PETROLEUM OILS

FIELD OF THE INVENTION

The field of this invention resides in the removal of nitrogen compounds from fossil fuels inclusive of petroleum oils. This invention seeks to vitiate problems of nitrogen content indigenous in petroleum oils such as those derived on the West Coast of the United States and in particular in the Los Angeles basin. These nefarious nitrogen compounds create a major problem in downstream processing of the crude oil by forming heterocyclic nitrogen compounds and amine compounds which act as a degradation agent for many of the metals used in the reactors and distillation units necessary to acquire the various substrates from the petroleum distillates. They are also known to be strong poisons for many catalysts used in the refineries. Various prior methods have been employed for separating nitrogen compounds from crude oil such as the use of gaseous sulfur dioxide and the use of inorganic acid agents.

This invention seeks to eliminate uniphase treatment of a petroleum oil to concentrate and extract the nitrogen compounds. While it is not possible to feasibly remove all nitrogen compounds from petroleum oils it is highly desirous that the content of the nitrogen compounds be reduced to a feasible minimum to reduce the poisoning of the catalyst in downstream processing and to eliminate hydrotreating of lubricants, fuel oils, etc. before their eventual end use. This unique two step process first concentrates the heterocyclic nitrogen compounds then excises the same via treatment with a lower aliphatic carboxylic acid or mixture thereof.

Current practice for excising these nitrogen compounds resides in hydrorefining a petroleum oil in the presence of hydrogen and an hydrorefining catalyst at high severities of temperature and pressure. This technique seeks to actually convert the nitrogen compounds to less troublesome nitrogen components which can be removed in downstream processing. This technique also results in a great economic disincentive to simply convert a nefarious compound to another less troublesome compound.

The field of this invention resides in a two-step nitrogen reduction process consisting of a first step of "Basic Nitrogen Enhancement" in which the basic nitrogen concentration of the original feed is enhanced, followed by a physical separation scheme whereby, at complexing conditions, the enhanced basic nitrogen compounds of the petroleum oil are complexed with a carboxylic acid solvent or complexing agent. This will result in an overall savings in total hydrogen consumption even though it may be desirable to mildly hydrotreat the petroleum oil before contact with the extracting agent.

BACKGROUND OF THE INVENTION

In addition to the hydrorefining state-of-the-art practiced in the presence of a hydrorefining catalyst, hydrogen and high temperatures and pressures, other techniques have been disclosed for the removal of these nitrogen compounds. Recently, two U.S. patents issued to Baset, U.S. Pat. Nos. 4,332,676 and 4,332,675 which disclose a process for the removal of basic nitrogen compounds from organic streams inclusive of petroleum oils utilizing gaseous sulfur dioxide to thereby precipitate a salt comprising the basic nitrogen compound, sulphur dioxide and water with downstream separation of the precipitated salt. Both of these patents concern a single phase treatment system with the content of water in the separation system in '675 being substantially eliminated and the quantity of water in '676 being such that only a single phase system is existent. In fact, in the latter reference the addition of water is limited to a concentration only to the extent that a two-phase liquid system will never be formed. It is also disclosed that a non-polar solvent can be utilized in the contacting step such as a petroleum ether, a lower paraffinic hydrocarbon or an aromatic hydrocarbon such as toluene. While the types of basic organic nitrogen compounds extracted in the instant invention are either similar to or the same as those described at Column 2 of the '676 disclosure, the means by which the process is undertaken in the instant invention is very different from that disclosure.

In the October 1983 issue of Chemical Engineering by Desai and Madgavkar, cognizance is taken of a method to remove catalyst-poisoning nitrogen compounds from shale oil by solvent extraction with a formic acid/water solvent prior to hydrotreating. The advantage of this technique is a lowering of the hydrogen consumption and a reduction of the nitrogen content to a tolerable level feasible for downstream processing of the shale oil. It should be noted that the nitrogen compounds indigenous to the shale oil are unique and will not necessarily behave in the same manner as the nitrogen compounds indigenous to the petroleum oils. Further, shale oil liquids are derived from a polymeric material "kerogen", which is thermally decomposed into liquids which contain the nitrogen molecules. Petroleum oils are formed by biological and chemical action by nature over a much longer period of time, are more mature than shale-derived oils and have a chemical constituency far different from shale-derived oils. Also, the starting materials in formulation of the petroleum oil versus the shale oil are very different and lead to a lower content of nitrogen compounds for the petroleum oil than the shale oil. The method of nitrogen extraction in re the latter can simply not be extrapolated to the former.

In addition of inorganic acids to petroleum oils to reduce the quantity of nitrogen compounds has long been established. For example, in U.S. Pat. No. 2,352,236 anhydrous hydrogen chloride is added to improve a charge stock for catalytic cracking. A dilute acid, such as sulfuric acid, is disclosed in U.S. Pat. No. 1,686,136 to complex nitrogen compounds existent in a California-derived crude oil. The organic carboxylic acids, sometimes referred to as low molecular weight fatty acids of high volatility, have been used to complex nitrogen-bases in such disclosures as U.S. Pat. Nos. 2,263,175 and 2,263,176. While these latter two references employ a portion of the chemical mechanism utilized in the second step of this two-step nitrogen extraction process, they fail to disclose, suggest or even hint at the use of a first step to concentrate the nitrogen compounds to more effectively utilize the treating and excising step with the lower aliphatic carboxylic acids. Also, these references fail to teach the use of a combination carboxylic acid system such as an admixture of formic and acetic acid, which is important in light of the cross production of an acetic acid, i.e. formic acid will usually be present as an impurity. Thus, it may be economic and advantageous to use a mixture of such co-produced carboxylic acids.

OBJECTS AND EMBODIMENTS

An object of this invention is to provide a process for the physical separation of heterocyclic basic nitrogen compounds by means of a specific easily-obtained complexing agent available to refinery operators.

Another object of this invention is to provide a process for extracting basic nitrogen compounds from a petroleum oil, such as a crude oil or vacuum gas oil, in the presence of an extraction or complexing agent less corrosive than an inorganic acid (such as sulfuric acid) and in a two-phase system which will result in a much more feasible downstream separation and recycle of the applicable extraction agent.

Another object of this invention is to provide a first step to concentrate the heterocyclic basic nitrogen compounds by either hydrotreating or distillation so as to form two separate streams, one rich in basic nitrogen-containing compounds which are extracted by the second step herein utilizing a lower aliphatic carboxylic acid and a nitrogen lean stream which is further processed without the problems of nitrogen corrosion in condensors, fractionators, reactors or the like and without the problem of poisoning of catalysts.

Another object of this invention is to provide a feasible method by which onsite nitrogen extraction can be realized at a refinery or oil well, such as contained in the Los Angeles basin, to feasibly remove the nitrogen compounds without resort to hydrorefining or employment of dangerous sulfur dioxide.

Another object of this invention is to utilize a $C_1$ to $C_{15}$ carboxylic acid or mixtures thereof, and if desired a cosolvent selected from the group consisting of $C_5$ to $C_{10}$ paraffinic hydrocarbons, $C_1$ to $C_{10}$ alkanols and a naphtha solvent to complex heterocyclic basic nitrogen compounds from a petroleum oil, which complex can be easily destroyed in downstream separation so as to provide feasible recycle of the complexing agent and any cosolvent utilized to provide a better admixture of the two-phase system.

In one aspect an embodiment of this invention resides in a two step process for excising heterocyclic basic nitrogen compounds from a petroleum oil which comprises: (1) treating said petroleum oil in a hydrotreating zone containing a hydrotreating catalyst effective to promote hydrotreating of said petroleum oil in the presence of hydrogen at a temperature of from about 600° F. to about 850° F., a pressure of from about 25 atmospheres to about 150 atmospheres and a liquid hourly space velocity of about 0.5 to about 5.0 to form a petroleum oil fraction rich in heterocyclic basic nitrogen compounds and (2) treating said heterocyclic basic nitrogen-rich petroleum oil in a two phase separation zone in contact with an extraction agent comprising an aqueous solution of a lower aliphatic carboxylic acid at separation conditions, to complex at least a portion of said heterocyclic basic nitrogen compounds with said lower aliphatic carboxylic acid in said aqueous phase, passing said two phases to a separation zone to separate said petroleum oil containing a lower content of said heterocyclic basic nitrogen compounds from said aqueous phase containing said lower aliphatic carboxylic acid and an increased quantity of said heterocyclic basic nitrogen compounds, and recovering said petroleum oil having at least a portion of said heterocyclic nitrogen compounds originally present in the petroleum oil excised therefrom.

Another embodiment of this invention resides in a process for removing heterocyclic basic nitrogen compounds from a petroleum oil in a two step process wherein said second step includes a two phase separation system which comprises: heating said petroleum oil containing said heterocyclic basic nitrogen compounds to a temperature of from about 400° F. to about 700° F.; passing said heated petroleum oil to a hydrotreatment zone containing hydrotreating catalyst effective to promote hydrotreating of said petroleum oil in the presence of hydrogen at a temperature of from about 600° F. to about 800° F., a pressure of from about 25 atmospheres to about 150 atmospheres and a liquid hourly space velocity of about 0.5 to about 5.0 to produce a hydrotreated heated petroleum oil; separating, in a first separation zone, at first separation conditions, said hydrotreated petroleum oil to a heterocyclic basic nitrogen lean heated and hydrotreated petroleum oil and a heterocyclic basic nitrogen-rich heated and hydrotreated petroleum oil; passing said hydrotreated heated heterocyclic basic nitrogen-rich petroleum oil to a two phase second separation zone equipped with mixing means wherein one phase comprises said hydrotreated heated heterocyclic nitrogen-rich petroleum oil and wherein one phase comprises an extraction agent consisting essentially of a $C_1$–$C_{15}$ aliphatic carboxylic acid to extract and complex said heterocyclic basic nitrogen compound, at two phase second separation conditions, and to thereby extract said heterocyclic basic nitrogen compounds and produce a two phase extraction zone effluent stream; passing said two phase extraction zone effluent stream to a phase separation zone to produce, at phase separation conditions, a stream of petroleum oil low in heterocyclic basic nitrogen compounds and an aqueous phase rich in said $C_1$–$C_{15}$ aliphatic carboxylic acids and containing extracted basic heterocyclic nitrogen compounds; passing said aqueous phase to a third separation zone to produce, at third separation conditions, a stream containing said heterocyclic basic nitrogen compounds and a recycle aqueous stream of a $C_1$–$C_{15}$ aliphatic carboxylic acid; and recycling at least a portion of said aqueous stream of said $C_1$–$C_{15}$ aliphatic carboxylic acid to said two-phase second separation zone.

Another aspect of this invention resides in a two-step process for excising heterocyclic basic nitrogen compounds from a petroleum oil contained therein which comprises (a) distilling in a distillation zone said petroleum oil to a split stream, one of said streams containing an enhanced quantity of heterocyclic basic nitrogen compounds and the other stream containing a diminished quantity of heterocyclic basic nitrogen compounds and after separation of said split streams, (b) treating said stream having enhanced heterocyclic basic nitrogen compounds in a two phase separation-extraction zone in contact with an extraction agent comprising an aqueous solution of a lower aliphatic carboxylic acid, at two phase separation conditions to transfer at least a portion of said heterocyclic nitrogen compounds to said aqueous solution to provide a petroleum oil with a diminished content of said heterocyclic basic nitrogen compounds and an aqueous extraction stream of increased content of heterocyclic basic nitrogen compounds, and recovering said petroleum oil having at least a portion of the heterocyclic nitrogen atoms excised therefrom.

Another aspect of this invention resides in a process for the removal of heterocyclic basic nitrogen compounds from a pretreated petroleum oil to enhance the concentration of heterocyclic basic nitrogen compounds at a temperature of from ambient to about 300° F. and a presure of about 1 atmosphere to about 20 atmospheres in the presence of a mixing means to remove at least a portion of said heterocyclic basic nitrogen compounds from said petroleum oil, the improvement which consists of use of an aqueous complexing agent comprising a $C_1$ to $C_{15}$ aliphatic carboxylic acid.

BRIEF DESCRIPTION OF THE INVENTION

This invention deals with a two-phase complexing system to excise heterocyclic basic nitrogen compounds from a petroleum oil which has been previouly treated to enhance the concentration of heterocyclic basic nitrogen compounds therein utilizing as an extraction or complexing agent a $C_1$ to $C_{15}$ aliphatic carboxylic acid. The two-phase extraction system is used as the second step of this two step process and may have a cosolvent or mixing solvent present therein selected from the group consisting of $C_5$ to $C_{10}$ paraffins, $C_1$ to $C_{10}$ alkanols and naphtha solvents. And the extraction step is only practiced after a first process step inclusive of mild hydrotreating or distillation to convert some of the acidic and/or neutral compounds to heterocyclic basic nitrogen compounds.

DETAILED DESCRIPTION OF THE INVENTION

The present invention is not concerned with how the petroleum oil is derived having the basic nitrogen compounds contained therein. The various fossil fuels may be either those naturally derived from geological sources or those previously treated to modify the molecular structure of same. Thus, instant crude oils from such fields as Mexico, California and Texas, which are very high in nitrogen compounds, are clearly contemplated to be within the scope of this invention. Also, gas oils and other refinery streams such as fluid catalytic cracking feed material, coker gas oil, vacuum distillate oil, etc. are contemplated to be within the confines of this invention.

In accordance with this invention, any heterocyclic basic nitrogen compound and its petroleum substrate are pre-heated to a temperature in excess of 400° F. or in excess of 700° F. when distillation is the choice of the nitrogen-enhancing procedure. After preheating, the petroleum is subjected to the first process step wherein the heterocyclic basic nitrogen compounds are enhanced in relative concentration. This step is performed by a splitting or treating of the petroleum oil by any method known to those of skill in the art, but mild hydrotreating or distillation or hydrotreating coupled with distillation are the most preferred techniques to be used in this process.

In one embodiment of this invention, the petroleum oil is subjected to hydrotreating under mild conditions inclusive of a temperature of about 600° F. to about 800° F., a pressure of about 25 atmospheres to about 150 atmospheres and a liquid hourly space velocity of about 0.5 to about 5. This hydrotreating is usually performed in the presence of a conventional hydrotreating catalyst, which process parameter is however not relevant to the inventive concept of this invention. Usually these hydrotreating catalysts comprise a refractory inorganic oxide support having deposited thereon various metals of the period Table such as those metals derived from Group VIII and/or Group VIB of the Periodic Table. Specific examples of these hydrotreating catalysts concern a platinum catalyst modified with molybdenum or a vanadium nickel catalyst modified with tungsten. The actual weight percent of the metals on the catalyst are clearly within the confines of those of reasonable skill in the art and need not be exemplified herein.

The enhancement of the concentration of the basic heterocyclic nitrogen compounds can also be accomplished by a distillation step. It is typically observed that such basic nitrogen compounds tend to concentrate disproportionately in the heavier fractions of petroleum derived feedstocks. A petroleum oil is charged to a fractional distillation zone maintained at a temperature at the top of the zone of about 200° F. to about 700° F. and a temperature at the bottom of the zone of a temperature of about 500° F. to about 1100° F. The temperatures maintained in the distillation zone will be characteristic of the petroleum feed in question and may vary substantially with the nature of the feed. Normally, the petroleum oil will be divided into two streams, one having a deficiency of heterocyclic basic nitrogen compounds vis-a-vis the feed material and the other stream will be rich in heterocyclic basic nitrogen compounds. It is not necessary to have only two streams but the purpose is to concentrate heterocyclic basic nitrogen compounds in a lesser volume of a heterocyclic basic nitrogen rich stream. To illustrate the fact that different temperatures will be required for different petroleum feedstocks, one can study their boiling point ranges. For instance, a crude oil may have a range of 100° F. and above. In this case, the stream deficient in heterocyclic basic nitrogen may have a boiling point of 500° F. or less. On the other hand, in a vacuum gas oil with a boiling point range of 450° F. to 1000+°F., the stream deficient in heterocyclic basic nitrogen may have a boiling point of 800° F. or less. Alternately, the heterocyclic basic nitrogen compound enhancement procedure may be a combination of both hydrotreating and distillation. A hydrotreated petroleum feed stream can be distilled to further enhance the relative concentration of the heterocyclic basic nitrogen compounds or an effluent (preferably the bottoms) derived from a distillation zone can be hydrotreated to produce more heterocyclic basic nitrogen compounds therein.

After distillation or hydrotreating or both, the heterocyclic basic nitrogen-rich petroleum fraction is separated from the heterocyclic basic nitrogen-lean petroleum fraction. This separation is undertaken either in the aforementioned distillation zone or in any other type of separatory equipment for treating a hydrotreated distillate oil. In this manner, a feed stream to the second process step herein is acquired having an enhanced concentration of heterocyclic basic nitrogen compounds. It is much more feasible to eliminate the heterocyclic basic nitrogen compounds in this manner and surprisingly the aliphatic carboxylic acids, especially those pertaining to a mixture of lower carboxylic aliphatic acids, will have a greater effect upon the enhanced heterocyclic basic nitrogen-rich feed stream vis-a-vis the original petroleum oil which has a lower concentration of the heterocyclic basic nitrogen compounds.

The extraction agent utilized in the second step of this two-step process is commonly referred to as a complexing or extraction agent and comprise aliphatic organic carboxylic acids. It is preferred that these carboxylic acids be limited to 1 to 15 carbon atoms such as exemplified by formic acid, acetic acid, propionic acid, n-butyric acid, isobutyric acid, valeric acid, trimethylacetic acid, caproic acid, n-heptylic acid, caprylic acid, pelargonic acid, nonanoic acid, decanoic acid, undecanoic acid, dodecanoic acid, tridecanoic acid, tetradecanoic acid, pentadecanoic acid, etc. It is preferred that the aliphatic carboxylic acid be present in admixture of another of the aliphatic carboxylic acids. In this manner the neat production product of acetic acid, which usually contains some formic acid, can be used directly as the extraction agent without any purification step. It is also contemplated that the $C_1$ to $C_{15}$ aliphatic carboxylic acid be substituted by a moiety chosen from the halogen group of the Periodic Table. Such halogen moieties are one or more of fluoro, chloro-, bromo-, and iodo-moieties. Exemplary of these substituted carboxylic acids are fluoroacetic acid, chloroacetic acid, bromoacetic acid, iodoacetic acid, dichloroacetic acid, trichloroacetic acid, alpha-chloropropionic acid, beta-chloropropionic acid, etc.

The aliphatic carboxylic acids having from 1 to 15 carbon numbers or the halo-substituted carboxylic acids may be present conjunctly with an inert cosolvent. This cosolvent is described as being inert in character in that it does not function as a complexing agent for the heterocyclic basic hydrogen compound. It is necessary in some cases to have this cosolvent present to facilitate intimate phase contact between the two-phase system of the petroleum oil and the aqueous phase containing the aliphatic carboxylic acid. These cosolvent can be considered a mixing means or as an aid to a mixing means. Examples of such inert cosolvents comprise $C_5$ to $C_{10}$ paraffins such as pentane, hexane, heptane, octane, nonane and decane, $C_1$ to $C_{10}$ alkanols such as methanol, ethanol, butanol, propanol, pentanol, hexanol, heptanol, octanol, nonanol, decanol, and a naphtha solvent boiling in the range of 120° F. to about 450° F. or even any admixture of the respective co-solvents.

The quantity of $C_{1-15}$ aliphatic carboxylic acids necessary to complex the heterocyclic basic nitrogen compounds is dependent on the quantity of heterocyclic basic nitrogen compounds existent in the enhanced petroleum oil fraction which is to be treated via the extraction agent. In the practice of this invention, it is preferred that at least one mole of carboxylic acid be present for each mole of heterocyclic basic nitrogen compound present in the artifically-derived enhanced petroleum oil fraction. Most preferably, 1.5 mols of carboxylic acid per mol of the heterocylic basic nitrogen compound will be present in the extraction zone having two phases contained therein. It is of course possible that a larger amount of the carboxylic acid can be utilized than is necessary to adequately complex the heterocylic basic nitrogen compounds, however, when an over stoichiometric amount of carboxylic acid is utilized, an undesirable hardship is realized in the downstream separation of the aqueous carboxylic acid phase from the enhanced petroleum oil fraction having an elevated content of heterocylic basic nitrogen compounds.

The second process step of this invention concerns a two-phase system for complexing or extracting the heterocylic basic nitrogen compounds. One phase is of course the petroleum oil containing the nefarious concentrated heterocyclic basic nitrogen compounds while the second phase is an aqueous phase having a $C_{1-15}$ aliphatic carboxylic acid complexing agent dissolved therein. The quantity of water in the liquid phase must be sufficient to insure creation and maintenance of a two phase system. It is preferred that the quantity of water be maintained at least to a degree to be a viable a solvent for the $C_{1-15}$ aliphatic carboxylic acid in the liquid phase. The concentration of the carboxylic acids in the aqueous phase will be from about 20 to about 95 weight percent.

The amount and type of heterocylic basic nitrogen compounds is easily ascertained by a chemical analysis of a fungible sample of the applicable petroleum oil. While not wishing to be bound by any specific heterocylic basic nitrogen compound, it is believed that most prevalent nitrogen compounds in petroleum oils include at least one of azetidine, azole, aziridine, pyridine, pyrollidine, benzimidazole, 1,3-benzisodiazole, 1,2-benzisoxazine, benzofuran, pyrimidine, quinoline, quinoxaline, 1,2,3, 4-tetrazole, pyridazine, piperazine, piperdine, petazine, tetrahydroquinoline, phenthridine.

The extraction conditions utilized in the two-phase system are a temperature of ambient to 300° F., and a pressure of 1 atmosphere to 20 atmospheres. A preferred range of extraction conditions includes a temperature of from about 90° F. to about 180° F and, a pressure of from about 2 atmospheres to about 10 atmospheres. A most preferred range of extraction conditions include a temperature of from about 100° F. to about 140° F., and a pressure of from about 2 atmospheres to about 3 atmospheres. The extraction section utilized in this invention can be any conventional solvent extraction equipment which provides a mixing means for adequate intermixture of the two-phase system. Such mixer settlers or columns are commonplace in the art and are exemplified by such apparatus as a rotating disc contactor, a pulsating column, or the like. It is also contemplated that more than one stage of contacting may be used and that the extractions may be repeated to continuously provide a petroleum oil effluent with less quantities of the heterocylic basic nitrogen compounds. It is preferred that the extraction is carried out at sufficiently high temperatures to facilitate intimate mixing of both phases and that, if desired, the above cosolvent can be present to give a better intermixture of the components. After the petroleum oil has been derived from the two phase extraction system it can then again be mixed with the heterocyclic basic nitrogen compound-lean petroleum oil fraction derivative from the first enhancement step. Thereafter, hydrocarbon processing can be undertaken without the presence of the troublesome heterocyclic basic nitrogen compounds.

DETAILED DESCRIPTION OF THE DRAWINGS

Figure 1:
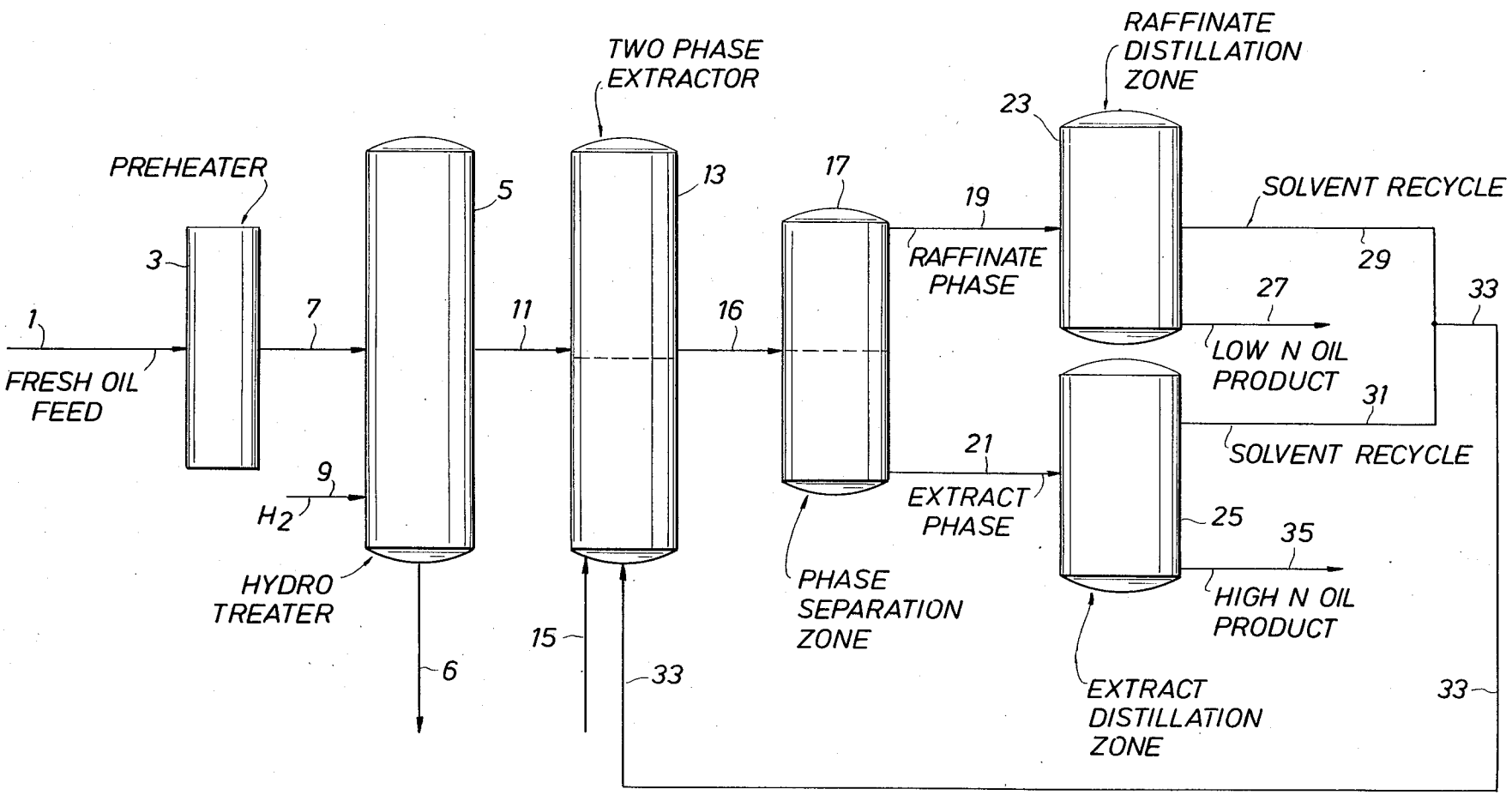
FIG. 1 is a flow scheme of the instant heterocylic basic nitrogen compound extraction system of this invention where the nitrogen enhancement step comprises only hydrotreating.

While not wishing to be bound by any specific flow scheme herein, it is believed that the instant FIG. 1 is disclosive of one embodiment of the instant process. Fresh petroleum oil is charged through conduit 1 to preheater section 3 to raise the temperature of the same to about 400° F. to about 650° F. After this feed preheating, the petroleum oil is hydrotreated in hydrotreater 5 fed by the preheated oil fed in conduit 7 from preheater 3 and extrinsic hydrogen from conduit 9. A conventional hydrotreating or hydrorefining catalyst may be present in hydrotreater 5 which is maintained under mild hydrotreating conditions of about 600° F. to about 850° F. and a pressure of about 25 atmospheres to about 140 atmospheres.

In substitution of hydrotreater 5 another embodiment of this invention resides in the use of a distillation unit which will provide a rich and lean heterocyclic basic nitrogen compound containing petroleum oil. See FIG. 3. Subsequent to hydrotreating, the preheated-hydrotreated petroleum oil with an enhanced quantity of heterocyclic basic nitrogen compounds is fed to the second process step of this invention via conduit 11, i.e. two-phase solvent extraction zone 13 having a petroleum oil phase and an aqueous phase existent therein. It is possible to withdraw a stream lean in heterocyclic basic nitrogen from hydrotreater 5 in conduit 6. The aqueous phase comprises water with an applicable concentration of a $C_1$ to $C_{15}$ aliphatic carboxylic acid or mixtures thereof added to two-phase solvent separation extraction zone 13 via conduit 15 or recycle conduit 33 or both. The two phase solvent extraction zone may actually encompass more than one vessel, but any such number will be connected in sequence so as to continually diminish the quantity of heterocylic basic nitrogen compounds as they pass through the respective repeated two-phase solvent extraction zones. Zone 13 is operated in association with a mixing means (not shown in the drawing). The solvent in conduit 15 can again be complimented by recycle solvent in conduit 33 or if desired a virgin solvent can be added to zone 13 with a cosolvent.

The two phase admixture system is withdrawn through conduit 16 from the two phase extraction unit 13 and passed to two phase separation zone 17. Therein a raffinate phase 19 and an extract phase 21 are formed by phase separation at a temperature of 60° F. to 200° F. and a pressure of 1 atmosphere to 10 atmospheres. The raffinate phase in conduit 19 is passed to raffinate distillation zone 23 for further separation to acquire a solvent recycle withdrawn from raffinate distillation zone 23 by conduit 29 and a low nitrogen oil product withdrawn from raffinate distillation zone 23 and conduit 27. The recycle solvent in conduit 29 is admixed with additional recycle solvent in conduit 31 and passed back to the two phase solvent extractor in conduit 33. The extract phase is treated in extract distillation zone 25 after passage thereto through conduit 21. A solvent recycle stream 31 is withdrawn from the extract distillation zone 25 and again passed back to the two phase solvent extractor. A high nitrogen content oil product is withdrawn in conduit 35 and processed for further acquisition of the mineral contents therein. The raffinate and extract distillation zones are maintained at any level of pressure and temperature as would be recognized by those of reasonable skill in the art. Exemplary of these conditions would be a top temperature of 100° F., a bottom temperature of 1000° F. and a pressure of 0.5 to 50 atmospheres.

Figure 2:
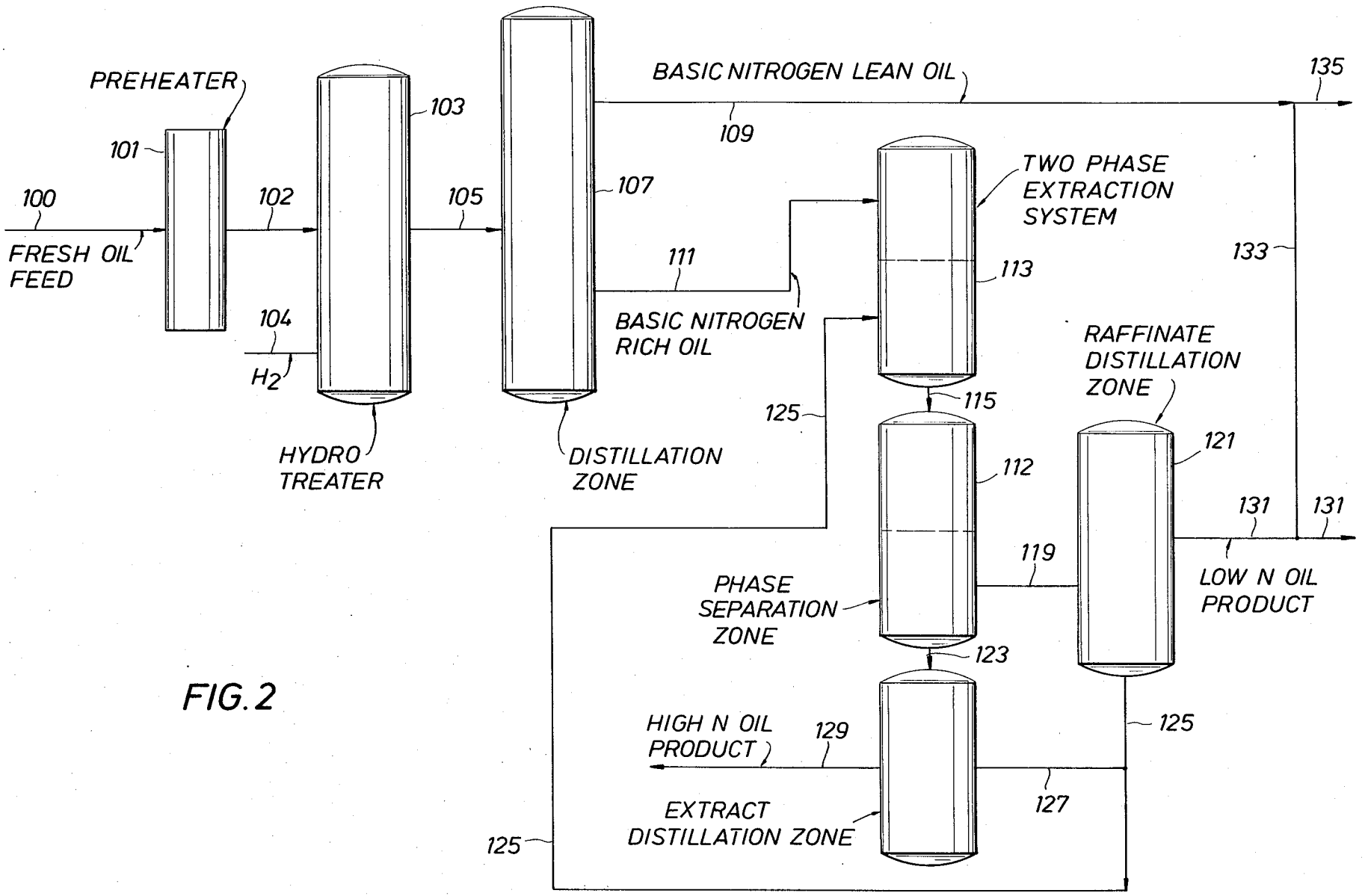
FIG. 2 is a flow scheme of the instant heterocyclic basic nitrogen compound extraction system of this invention where the nitrogen enhancement step comprises first hydrotreating then distillation.

FIG. 2 shows a second embodiment of this invention wherein the feed material is preheated, hydrotreated and then distilled to acquire the enhanced heterocyclic basic nitrogen compound concentration. More explicitly, a fresh oil feed in conduit 100 is passed to preheater 101 wherein it is again heated to a temperature of from about 400° F. to about 650° F. Thereafter, the heated fresh oil feed is withdrawn from preheater 101 in conduit 102 and passed to hydrotreating zone 103, which is operated under mild hydrotreating conditions of about 600° F. to about 850° F. and a pressure of from about 25 atmospheres to about 140 atmospheres in the presence of extrinsic hydrogen added by means of conduit 104. The preheated and hydrotreated fresh oil feed is withdrawn from hydrotreater 103 in conduit 105 and then passed to distillation zone 107. This zone is regulated at a top temperature of about 200° F. to about 700° F. and a bottom temperature of between 500° F. and 1100° F. at a pressure of from about 0.05 to about 1 atmospheres to acquire at least two distillate streams, one having a rich content of heterocyclic basic nitrogen components in conduit 111 and the other having a lean content of heterocyclic basic nitrogen contents in conduit 109.

The former is passed to a two phase extraction system 113 similar to the two phase extractor 13 of FIG. 1. Thereafter, a two phase extraction effluent stream is withdrawn in conduit 115 and passed to phase separation zone 117 wherein a raffinate phase in conduit 119 and an extract phase in conduit 123 are formed. The raffinate phase is passed to a raffinate distillation zone 121 which forms a recycle stream 125 and a low nitrogen oil product stream 131. A portion of the latter or all of the latter may be further combined with the heterocyclic basic nitrogen lean stream of conduit 109 and passed by means of conduit 135 to further hydrocarbon processing. The extract distillation zone is maintained at conditions to form a recycle solvent stream in conduit 127 which is admixed with recycle conduit stream 125 and a high nitrogen oil product stream in conduit 129 which may also be processed for the recovery of further hydrocarbon minerals. It is also feasible that any other type of separation process can be substituted for the raffinate or extract distillation zone such as water wash or other conventional means of separating the solvent from the petroleum fraction. It should also be noted that the hydrotreating zone and the distillation zone can be interchanged with the distillation zone occurring upstream of hydrotreating and the hydrotreating being effected only upon one portion of the distillate recovered from the distillation zone.

Figure 3:
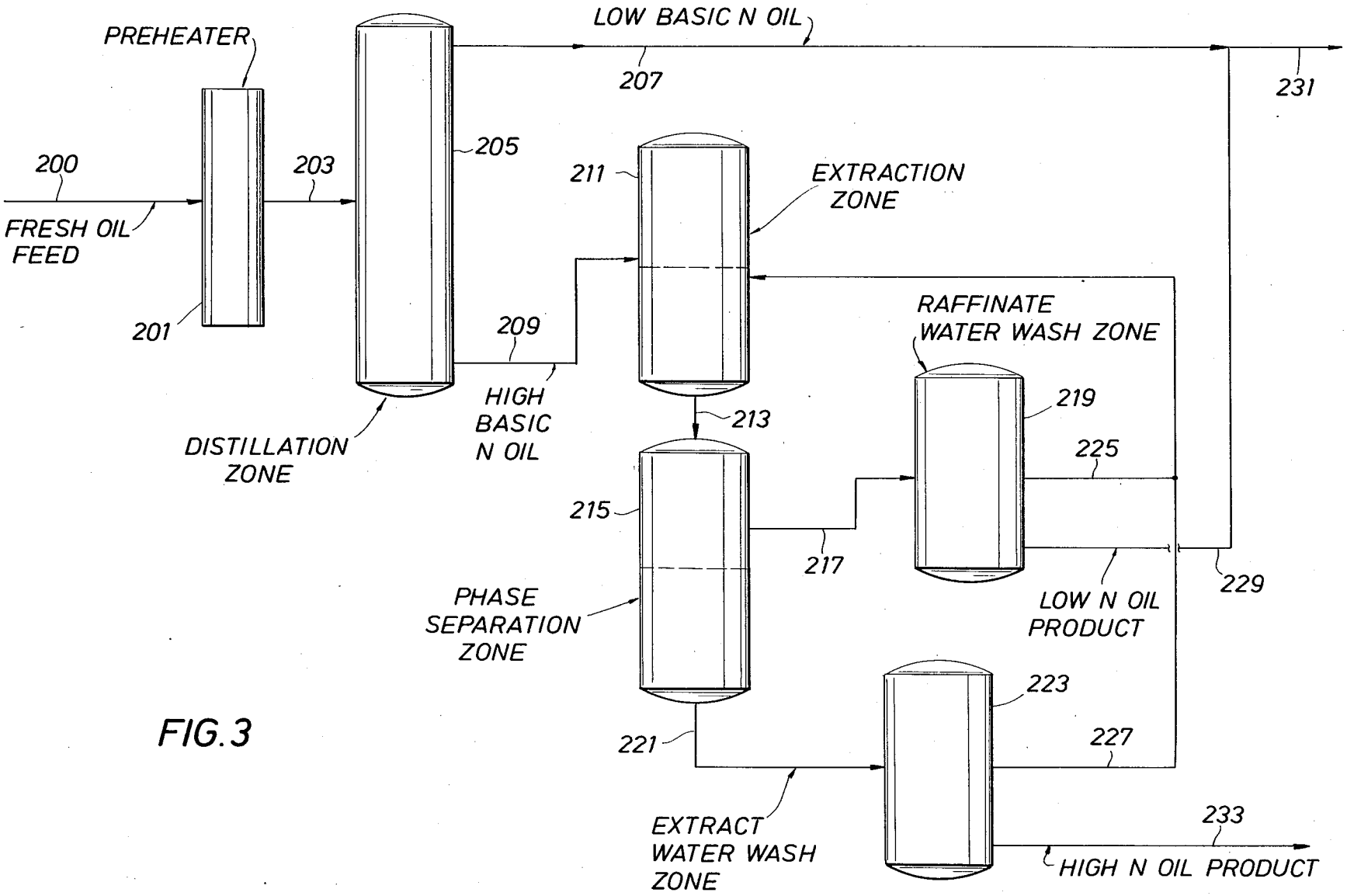
FIG. 3 is a flow scheme of the instant heterocyclic basic nitrogen compound extraction system of this invention where the nitrogen enhancement step comprises only distillation.

In FIG. 3 a fresh oil feed 200 is preheated in preheater 201 and passed by means of conduit 203 at a temperature of at least 700° F. to distillation zone 205. This zone is maintained at a top temperature of between 200° F. and 700° F. and a bottom temperature of between 500° F. and 1100° F. at a pressure of 0.05 atmospheres to about 1 atmosphere. Acquisition is made of a low content or lean content heterocyclic basic nitrogen compound in conduit 207 and a heterocyclic basic nitrogen enriched stream in conduit 209. The latter is passed to the two phase solvent extraction zone 211 from which a two phase solvent extraction zone effluent stream 213 is formed and passed to two phase separation zone 215. Therein a raffinate phase 217 and an extract phase 221 are withdrawn. The raffinate phase is passed to a raffinate water wash zone 219 wherein by water washing techniques a solvent recycle stream 225 is formed in addition to a low heterocyclic basic nitrogen oil product stream 229, a portion of which may be combined with low heterocyclic basic nitrogen compound stream 207 to form processing stream 231 which can be treated to further recovery its natural mineral content. The extract stream is passed to extract water wash stream 223 wherein by water wash techniques a recycle stream 227 is formed which is passed in accompaniment with recycle stream 225 to the extraction zone. A high nitrogen oil product is formed in conduit 233 which may again be either further processed for its hydrocarbon content or disposed of otherwise.

EXAMPLES

The illustrative embodiments described herein are exemplary of this process and are not given so as to have a limiting affect upon the claims hereinafter presented. While these examples were performed on a batch scale method, one of even modicum skill in the art will readily realize the extrapolation of these tests to the flow scheme as above described in FIG. 1.

In each of Examples 1 through 3 a vacuum gas oil with the following properties was treated with the applicable carboxylic acid.

TABLE I

| VACUUM GAS OIL | |
|---|---|
| Sulfur | 1.1 wt % |
| Total nitrogen | .45 wt % |
| Basic nitrogen content | 1658 ppm |
| Ni | 1.63 ppm |
| V | 0.35 ppm |
| API gravity | 15.0 degrees |
| H | 11.35 wt % |
| C | 86.43 wt % |
| O | 0.64 wt % |
| Boiling Point | |
| IBP | 472° F. |
| 25% | 709° F. |
| 50% | 816° F. |
| 75% | 914° F. |
| Final BP | 1124° F. |

EXAMPLE 1

In this example 50 gms of a sample of the vacuum gas oil of Table I were shaken for about 15 minutes at ambient temperature with 50 gms of a water solution containing approximately 70% acetic acid. Two phases were allowed to separate at about 113° F. to about 122° F. for approximately 15 minutes. The phases were separated and the oil phase thereafter analyzed for its quantity of basic nitrogen compounds. The basic nitrogen content was reduced to 1228 ppm representing a 26% decrease from the feed value. Very little sulfur, nickel or vanadium were removed from the vacuum gas oil.

EXAMPLE 2

In this example 50 gms of the vacuum gas oil were shaken for about 15 minutes at room temperature with 50 gms of a water solution containing approximately 90% acetic acid. The two phases were allowed to separate at room temperature for about 15 minutes. The phases were separated and the oil phase analyzed. The basic nitrogen content was reduced to 611 ppm representing a 63% decrease from the 1658 ppm basic nitrogen in the vacuum gas oil. Again, very little sulfur, nickel or vanadium were removed from the vacuum gas oil.

EXAMPLE 3

In this example, 3 kilograms of the vacuum gas oil were stirred with about 3 kilograms of an approximately 70% acetic acid solution in water. A motor driven stir means with an impeller was used to stir the mixture for two to three hours. The phases were allowed to separate over a period of about 12 hours and the oil phase analyzed. The oil phase contained about 890 ppm basic nitrogen representing a decrease of about 46% from the 1658 ppm basic nitrogen content of the vacuum gas oi.

EXAMPLE 4

In this example a sample of a vacuum gas oil was hydrotreated in the presence of a hydrotreating catalyst comprising nickel and molybdenum or alumina. This hydrotreating was undertaken under conditions at 690° F. and a pressure of 70 atmospheres to acquire the hydrotreated product. The hydrotreated oil contained 1109 ppm basic nitrogen. Approximately 100 gms of this hydrotreated oil was extracted 4 times as follows. Each time the oil phase was shaken for about 15 minutes at room temperature with about 100 gms of an approximately 90% acetic acid solution in water. The oil and solvent were allowed to segregate at room temperature and the phases thereafter separated. A small sample of the oil phase was analyzed and the remainder used for subsequent extraction. The basic nitrogen content of the oil phase after each extraction are shown in Table II.

TABLE II

| Extraction No. | PPM N in Oil Phase | % reduction based on hydrotreated content |
|---|---|---|
| 1st Extraction | 328 | 70% |
| 2nd Extraction | 196 | 82% |
| 3rd Extraction | 142 | 87% |
| 4th Extraction | 114 | 90% |

What I claim as my invention:

1. A two step process for excising heterocyclic basic nitrogen compounds from a petroleum oil which comprises:

(1) treating said petroleum oil in a hydrotreating zone containing a hydrotreating catalyst effective to promote hydrotreating of said petroleum-oil and thereby increase the total heterocyclic basic nitrogen content in the presence of hydrogen at a temperature of from about 600° F. to about 850° F., a pressure of from about 25 atmospheres to about 150 atmospheres and a liquid hourly space velocity of about 0.5 to about 5.0 to form a first petroleum oil fraction lean in heterocyclic basic nitrogen compounds and a second petroleum oil fraction rich in heterocyclic basic nitrogen compounds and (2) treating said petroleum oil fraction rich in said heterocyclic basic nitrogen compounds in a two phase separation zone in contact with an extraction agent consisting essentially of an aqueous solution of an aliphatic carboxylic acid having from one to fifteen carbon atoms at separation conditions, to form a petroleum oil phase and an aqueous phase and to complex at least a portion of said heterocyclic basic nitrogen compounds with said aliphatic carboxylic acid in said aqueous phase and diminish the quantity of nitrogen compounds in the petroleum phase, passing said two phases to a separation zone to separate said petroleum oil phase containing a lower content of said heterocyclic basic nitrogen compounds from said aqueous phase containing said aliphatic carboxylic acid extraction agent and an increased quantity of said heterocyclic basic nitrogen compounds, and recovering said petroleum oil phase having at least a portion of said heterocyclic basic nitrogen compounds originally present in the petroleum oil excised therefrom.

2. The process of claim 1 wherein said petroleum oil is selected from the group consisting of a crude oil and a fraction of a crude oil.

3. The process of claim 1 wherein said separation conditions comprise a temperature of from 106° F. to 140° F., and a pressure of 2 atmospheres to 3 atmospheres.

4. The process of claim 1 wherein said $C_1$–$C_{15}$ aliphatic carboxylic acid is selected from the group consisting of acetic acid, oxalic acid, formic acid, propionic acid, n-butyric acid and mixtures thereof.

5. The process of claim 1 wherein said aliphatic carboxylic acid is present with an inert organic cosolvent.

6. The process of claim 5 wherein said inert cosolvent comprises a paraffin hydrocarbon having from 5 to 10 carbon atoms.

7. The process of claim 5 wherein said inert cosolvent comprises a naphtha solvent having a boiling point of from 180° F. to 450° F.

8. The process of claim 1 wherein said aliphatic carboxylic acid is substituted with a halo moiety selected from the group consisting of chloro-, fluoro-, bromo- and iodo-moieties.

9. The process of claim 8 wherein said halo-substituted carboxylic acid is chloroacetic acid.

10. The process of claim 8 wherein said halo-substituted carboxylic acid is trifluoroacetic acid.

11. The process of claim 1 wherein said separation conditions comprise a temperature of from ambient to 300° F., and a pressure of 1 atmosphere to 20 atmospheres.

12. The process of claim 1 wherein said separation conditions comprise a temperature of from 90° F. to 180° F., and a pressure of 2 atmosphere to 10 atmospheres.

13. A process for removing heterocyclic basic nitrogen compounds from a petroleum oil in a two step process wherein said second step includes a two phase separation system which comprises:

(a) heating said petroleum oil containing said basic heterocyclic nitrogen compounds to a temperature of from about 400° F. to about 700° F.;

(b) passing said heated petroleum oil to a hydrotreatment zone containing hydrotreating catalyst effective to promote hydrotreating of said petroleum oil in the presence of hydrogen at a temperature of from about 600° C. to about 800° F., a pressure of from about 25 atmospheres to about 150 atmospheres and a liquid hourly space velocity of about 0.5 to about 5.0 to produce a hydrotreated heated petroleum oil having an increase in total heterocyclic basic nitrogen content;

(c) separating in a first separating zone, at first separation conditions, said hydrotreated petroleum oil into a heterocyclic basic nitrogen lean heated and hydrotreated petroleum oil stream and a heterocyclic basic nitrogen-rich heated and hydrotreated petroleum oil stream;

(d) passing said hydrotreated heterocyclic basic nitrogen rich petroleum oil stream to a two phase second separation zone equipped with mixing means, wherein one phase comprises an extraction agent consisting essentially of one or more $C_1$–$C_{15}$ aliphatic carboxylic acids to extract and complex said heterocyclic basic nitrogen compounds, at two phase second separation conditions, and to thereby extract said heterocyclic basic nitrogen compounds to produce a two phase extraction zone effluent stream;

(e) passing said two phase extraction zone effluent stream to a phase separation zone to produce, at phase separation conditions, a raffinate stream having said extraction agent and petroleum oil relatively low in heterocyclic basic nitrogen compounds and an extract stream having said extraction agent and petroleum oil relatively high in heterocyclic basic nitrogen compounds;

(f) passing said raffinate stream to a raffinate separation zone to separate an extraction agent recycle stream and a petroleum oil stream of relatively low heterocyclic basic nitrogen content; and (g) passing said extract stream to an extract separation zone to separate an extraction agent recycle stream and a petroleum oil stream of relatively high heterocyclic basic nitrogen content.

14. The process of claim 13 wherein said second two phase separation conditions comprise a temperature of 50° F. to 300° F., and a pressure of 1 atmosphere to 20 atmospheres.

15. The process of claim 14 wherein said phase separation conditions comprise a temperature of 60° F. to 200° F., and a pressure of 1 atmosphere to 10 atmospheres.

16. The process of claim 13 wherein said petroleum oil is selected from the group consisting of a crude oil and a fraction of a crude oil.

17. The process of claim 13 wherein said hydrotreating catalyst comprises a metal of Group VIII, a metal of Group VIB or combinations thereof supported on an inorganic oxide support.

18. The process of claim 13 wherein said basic heterocyclic nitrogen compounds include at least one of the compounds selected from the group consisting of azetidine, azole, aziridine, pyridine, pyrollidine, benzimidazole, 1,3-benzisodiazole, 1,2-benzisoxiozine, benzofuran, pyrimidine, quinoline, quinoxaline, 1,2,3,4 tetrazole, pyridazine, piperdine and pentazine.

19. The process of claim 13 wherein said mixing means comprises a rotating disc contactor.

20. The process of claim 13 wherein said mixing means comprises a pulsating column disc contactor.

21. The process of claim 13 wherein said $C_1$–$C_{15}$ aliphatic carboxylic acid is substituted with at least one moiety selected from the group consisting of chloro-, bromo-, fluoro- and iodo-moieties.

22. The process of claim 13 wherein said $C_1$–$C_{15}$ aliphatic carboxylic acid or acids is present with an inert cosolvent.

23. The process of claim 22 wherein said inert cosolvent is a $C_5$ to $C_{10}$ paraffin hydrocarbon.

24. The process of claim 13 wherein said first separation conditions comprise a temperature of about 500° F. to about 1100° F. and a pressure of about 0.05 atmospheres to about 2 atmospheres.

* * * * *